United States Patent [19]

Bielfeldt

[11] Patent Number: 4,921,418

[45] Date of Patent: May 1, 1990

[54] CONTINUOUSLY WORKING PRESS

[75] Inventor: Friedrich B. Bielfeldt, Eppingen, Fed. Rep. of Germany

[73] Assignee: Maschinenfabrik J. Dieffenbacher GmbH & Co., Eppingen, Fed. Rep. of Germany

[21] Appl. No.: 288,389

[22] Filed: Dec. 22, 1988

[30] Foreign Application Priority Data

Dec. 22, 1987 [DE] Fed. Rep. of Germany ..... 3743665

[51] Int. Cl.[5] ..... B30B 3/00

[52] U.S. Cl. ..... 425/371; 100/93 RP; 100/153; 156/555; 156/583.5

[58] Field of Search ..... 100/93 RP, 153, 154; 156/555, 583.5; 425/371

[56] References Cited

U.S. PATENT DOCUMENTS

| | | | |
|---|---|---|---|
| 3,723,230 | 3/1973 | Troutner | 156/583.5 |
| 3,948,021 | 4/1976 | Buck, Jr. et al. | 100/153 |
| 4,480,978 | 11/1984 | Gerhardt | 425/371 |
| 4,621,999 | 11/1986 | Gerhardt | 425/371 |
| 4,748,907 | 6/1988 | Schermutzki | 100/153 |

*Primary Examiner*—Jay H. Woo
*Assistant Examiner*—C. Scott Bushey
*Attorney, Agent, or Firm*—Foley & Lardner, Schwartz, Jeffery, Schwaab, Mack, Blumenthal & Evans

[57] ABSTRACT

A continuously working press is provided having a rolling rod conveyor connected to a guide chain, whereby in the critical entering arc and also in the tangential transition into the horizontal pressing zone the guide chain has the same arc dimension and secant dimension as the rolling rods, because they are guided coaxially with the same radius via entering gear wheels and lead-in gear wheels. Consequently, the orientation of the rolling rods orthogonal to the feeding direction is maintained. Furthermore, the rods are kept exactly equidistant during the transition from the entering arc into the horizontal pressing plane. Linear shifts are absorbed in an elastically compensating manner by bearing bolts composed of spring steel. The high spring forces which occur in the bearing bolts as a result of linear shifts of the rolling rods are absorbed in a compensating manner by thick sleeves and sextuple plate stacks of the guide chain.

14 Claims, 4 Drawing Sheets

CONTINUOUSLY WORKING PRESS

BACKGROUND OF THE INVENTION

1. Field of the Invention

The invention relates to a continuously working press for producing chipboards, fiberboards or plywood boards, and more particularly to a continuously working press having rolling rods which support rotating steel bands.

2. Discussion of the Related Art

Continuously working presses have previously been described which employ rolling rods to support rotating steel bands. For example, in order to transmit the high pressing force involved in these presses, German Reference No. 3,140,548 describes rolling rods which rotate between steel bands and press spars. These rolling rods are mounted at their ends and guided via bolts in plate-link chains.

In prior continuously working presses of this type, the chains extending laterally next to the pressing space of the press, being pure pulling and guiding chains, comprise large sturdy chain plates having portions which project from the chain path on one side, and in which several rolling rods are mounted respectively in a plane offset relative to the chain path. Several rolling rods are, therefore, arranged at a short distance from one another on a chain plate.

A similar press is described in German Reference No. 3,432,548, wherein the rolling rods are mounted in plate-link chains without stops and precentered to provide compensation for the rolling rods, and the plate-link chains have a chain-stud compensation between the chain studs and connecting plates. To provide for this compensation, bearing bolts of the rolling rods are inserted into long holes in the connecting plates by means of precentering springs.

The critical feature of these presses is the position of the rolling rods orthogonal to the feeding direction in the press. This orthogonal position must be maintained during the introduction of the rolling rods into the compression zone, especially during the transition of the rod's path from the entering arc into the horizontal pressing zone and also during the change of operating mode from idling to load operation in the horizontal pressing zone.

In the entering arc and in the transitional region of the compression zone from the entering arc into the horizontal pressing zone, the guide chains of the known presses do not perform this function since the guide chain is not guided in the plane of the rolling rods, but instead over a smaller radius in the region of this arc. Therefore, the arc dimension of the path of the rolling rod is larger than that of the guide chain.

SUMMARY OF THE INVENTION

Accordingly, the object of this invention is to provide a continuously working press in which a perfect and reliable orthogonal guidance is guaranteed in the run-in region during load operation and idling.

A further object of this invention is to provide a continuously working press in which exactly the same distance is maintained between the rolling rods.

Another object of this invention is to provide compensating play between the rolling rods and guide chain by simple means.

According to the present invention, the foregoing and additional objects are attained by providing a continuously working press whereby in the critical entering arc and also in the tangential transition into the horizontal pressing zone the guide chain has the same arc dimension and secant dimension as the rolling rods, because they are guided coaxially with the same radius via the entering gear wheels and lead-in gear wheels. Consequently, the orientation of the rolling rods orthogonal to the feeding direction is maintained. Furthermore, the rods are kept exactly equidistant during the transition from the entering arc into the horizontal pressing plane. Linear shifts—for example, in the horizontal pressing plane for the spacing of the guide chain—are absorbed in an elastically compensating manner by bearing bolts composed of spring steel. Compensating play between the bearing bolts and guide chains is therefore also provided simply and effectively. The high spring forces which occur in the bearing bolts as a result of linear shifts of the rolling rods are transmitted centrally into an annular bulge of double-tapered sleeves and then centrally into the guide chain. Therefore, they are not transmitted into the guide chains as eccentric load, which would cause damage to the guide chain under high loads. The spring forces acting centrally in the guide chain are absorbed by several plate stacks lying closely next to one another. At the same time, the plates are relatively thick so they absorb the spring force of the bearing bolts and guide the rolling rods at a geometrically fixed distance from one another in the critical entering arc and in the horizontal pressing plane.

Further advantages of this invention will become apparent hereinafter in the specification and drawings which follow.

DETAILED DESCRIPTION OF THE PREFERRED EMBODIMENT

Figure 4:
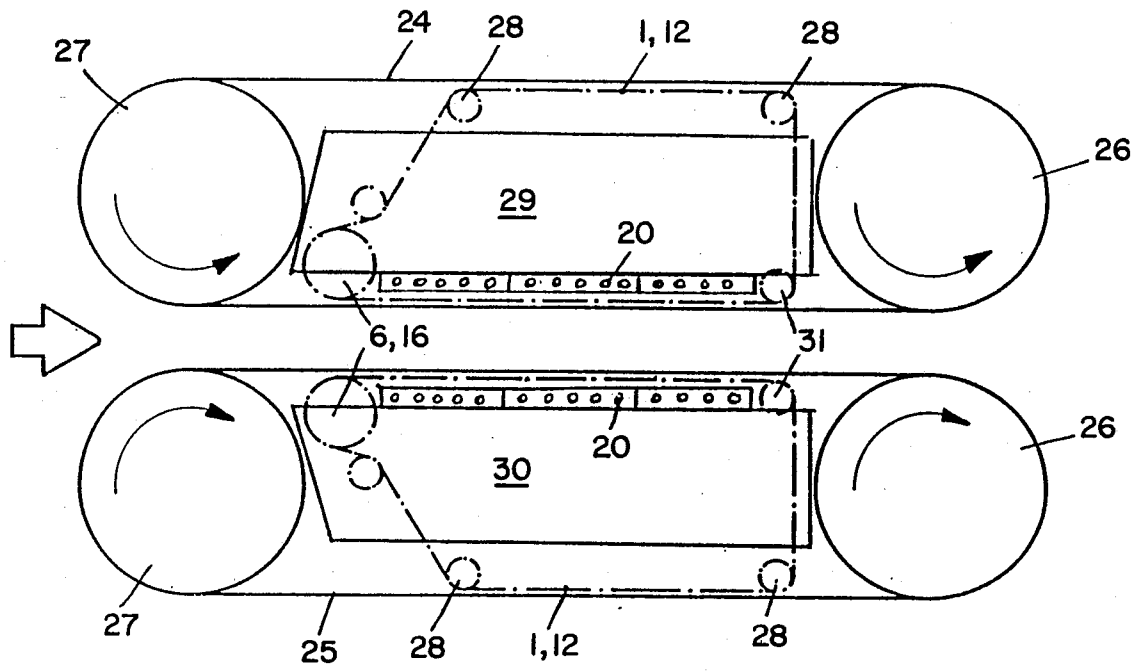
FIG. 4 is, in side view, a diagrammatic representation of a continuously working press according to the present invention.

As illustrated in FIG. 4, the present invention comprehends a continuously working press comprising a press table 30 and a moveable press ram 29 connected by tension columns (not shown). In order to adjust the press gap, the press ram 29 is moved vertically by hydraulic piston/cylinder arrangements (not shown) and is stopped in the selected position. Steel bands 24 and 25 are each guided round the press ram 29 and the press table 30, respectively, via driving rollers 26 and supporting rollers 27. To reduce the friction between the heating plates 20, which are attached to the press table 30 and to the press ram 29, and the rotating steel bands 24 and 25, there is for each steel band a rolling-rod conveyor which rotates in the same direction as the steel bands. This rolling rod conveyor is formed from rolling rods 1. The rolling rods 1, the axles of which extend transversely relative to the feeding direction, are connected together at predetermined intervals on the two longitudinal sides of the press in the link eyes of a guide chain 12. The rolling rods 1 are guided through the press by the steel bands 24, 25 on heating plates 20.

The connection of the rolling rods in the guide chain 12 is subjected to high stress under the high pressing force which is to be transmitted and which is exerted on the pressing article being fed through. A prerequisite for frictionless pressing operation is, therefore, that linear shifts of the rolling rods 1 in the pressing region do not cause destruction of the guide chains 12. Sufficient play between the rolling rods 1 and guide chain 12 is a critical factor for ensuring this in the pressing region. Moreover, a precondition for minimizing linear shifts in the pressing region is an exact orthogonal lead-in of the rolling rods in the entering arc and in the tangential transition into the horizontal pressing plane.

Figure 1:
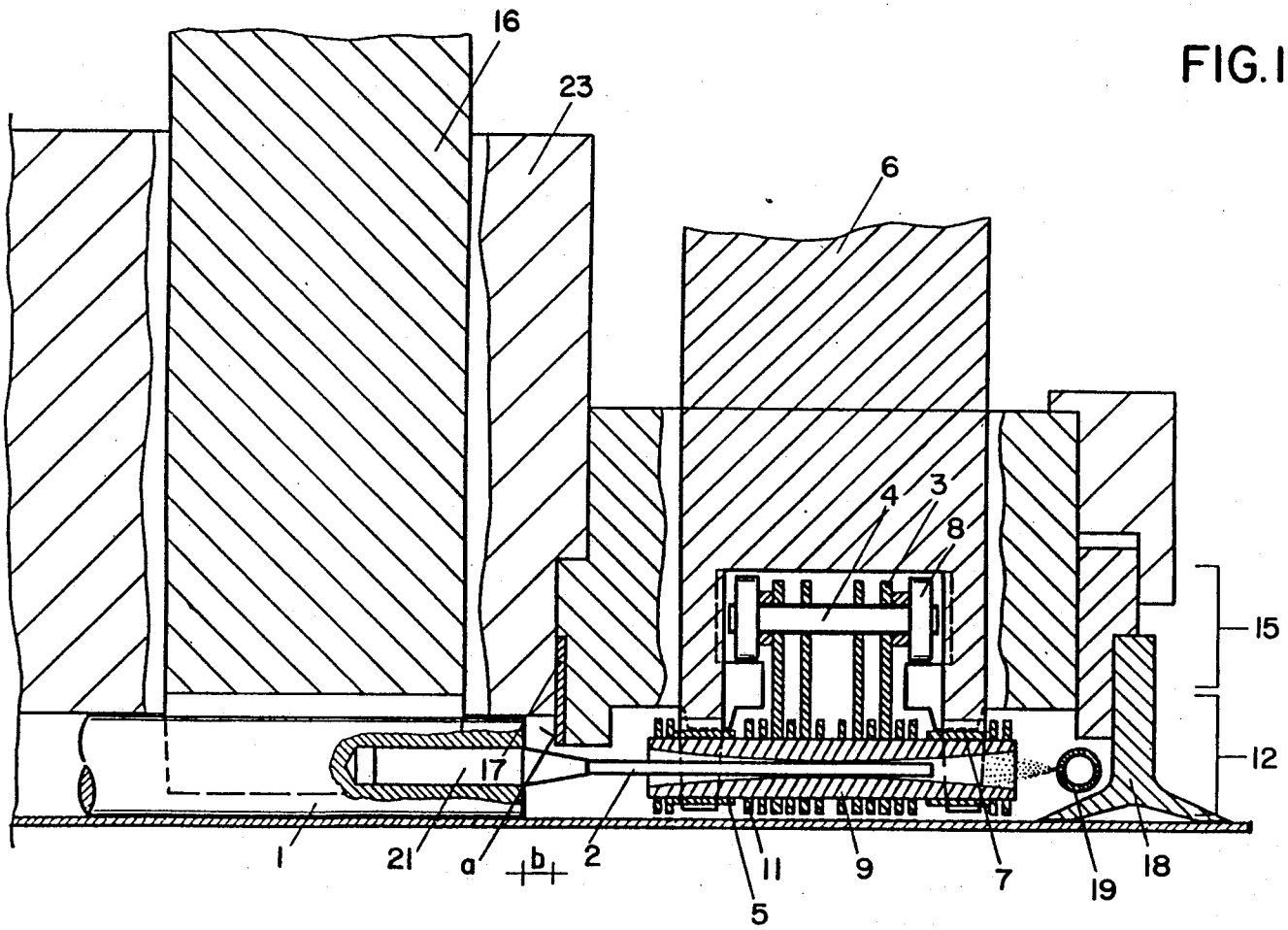
FIG. 1 is, in the front view, a part section through the guide chain with the rolling rods in the entering arc of a continuously working press according to the present invention.

Referring now to FIG. 1, the forces which are applied to rolling rods 1 are transmitted centrally via resilient bearing bolts 2 into double-tapered sleeves 9 of a guide chain 12 designed as a sleeve-type chain. More specifically, the spring forces of the bearing bolts 2 are absorbed centrally by the guide chain via annular bulges of the double-taper sleeves 9. Deviations from the division in the rolling movement of the rolling rods 1 are absorbed in a compensating manner by the resilient bearing bolts 2 composed of spring steel and thus, cannot cause any destruction of the guide chain 12.

Furthermore, for each rotating rolling-rod conveyor of the press ram 29 and press table 30, the rolling rods 1 are guided into the horizontal pressing plane by several lead-in gear wheels 16 and the guide chains 12 by two entering gear wheels 6 arranged laterally relative to the entering heating plate 23. The lead-in gear wheels 16 and the entering gear wheels 6 are arranged on one axle and have the same arc dimension and secant dimension in the entering arc and the tangential transition into the horizontal pressing plane. The center interval of the rolling rods 1 and guide chain 12 is always the same on the rollout radius of lead-in gear wheels 16 and entering gear wheels 6 and also does not vary at the transitional tangent to the horizontal pressing plane. Accordingly, an absolutely exact control of the rolling rods 1 in the entering arc, and also an exact orthogonal alignment of the rolling rods 1 into the compression zone are possible.

A further feature of the invention relates to the design of the guide chain 12 for supporting and absorbing the spring force occurring in the chain studs 9 from the bearing bolts 2. The guide chain 12 is constructed with a 6-point or 7-point plate connection lying closely adjacent. At the same time, plates 11 are made thick enough to absorb the spring force and guide the rolling rods at a geometrically fixed distance from one another in the critical entering arc and in the horizontal pressing plane. As a result of the compact arrangement of the plate stacks in the center of the sleeve chain, the guide chain 12 itself has an extremely high supporting effect in the direction of guidance.

In the guide chain 23 according to the invention, the radial and axial movements of the rolling rods 1 are absorbed in a centrally guided manner. In a particularly advantageous embodiment, the wear which occurs can be minimized by controlling spray lubrication. Accordingly, on each longitudinal side of the press several spray nozzles 19 are arranged between the guide chain 12 and the sealing rubber 18. The spray nozzles 19 can introduce oil into the guide lugs 10 in a controlled manner and consequently ensure good lubrication between the annular bulge and the bearing bolt 2. In a design of the bearing bolts 2 which is statically favorable, the end 21 pressed into bores in the rolling rods 1 is thickened conically.

In the guide chain 12 according to the present invention, the radial and axial movements of the rolling rods 1 are absorbed in a compensating and controlled manner. To limit the axial movement of the rolling rods 1 in the pressing region, hardened stop plates 17 projecting into the pressing region are mounted on the heating plates 20 on each longitudinal side of the press.

For each link 13 (FIG. 2) the guide chains 12 have two protective rollers 5 which are guided by corresponding entering gear wheels 6 engaging at two points. This arrangement provides for an exact orthogonal alignment of the rolling rods in the entering arc and better guidance of the guide chain 12.

Figure 3:
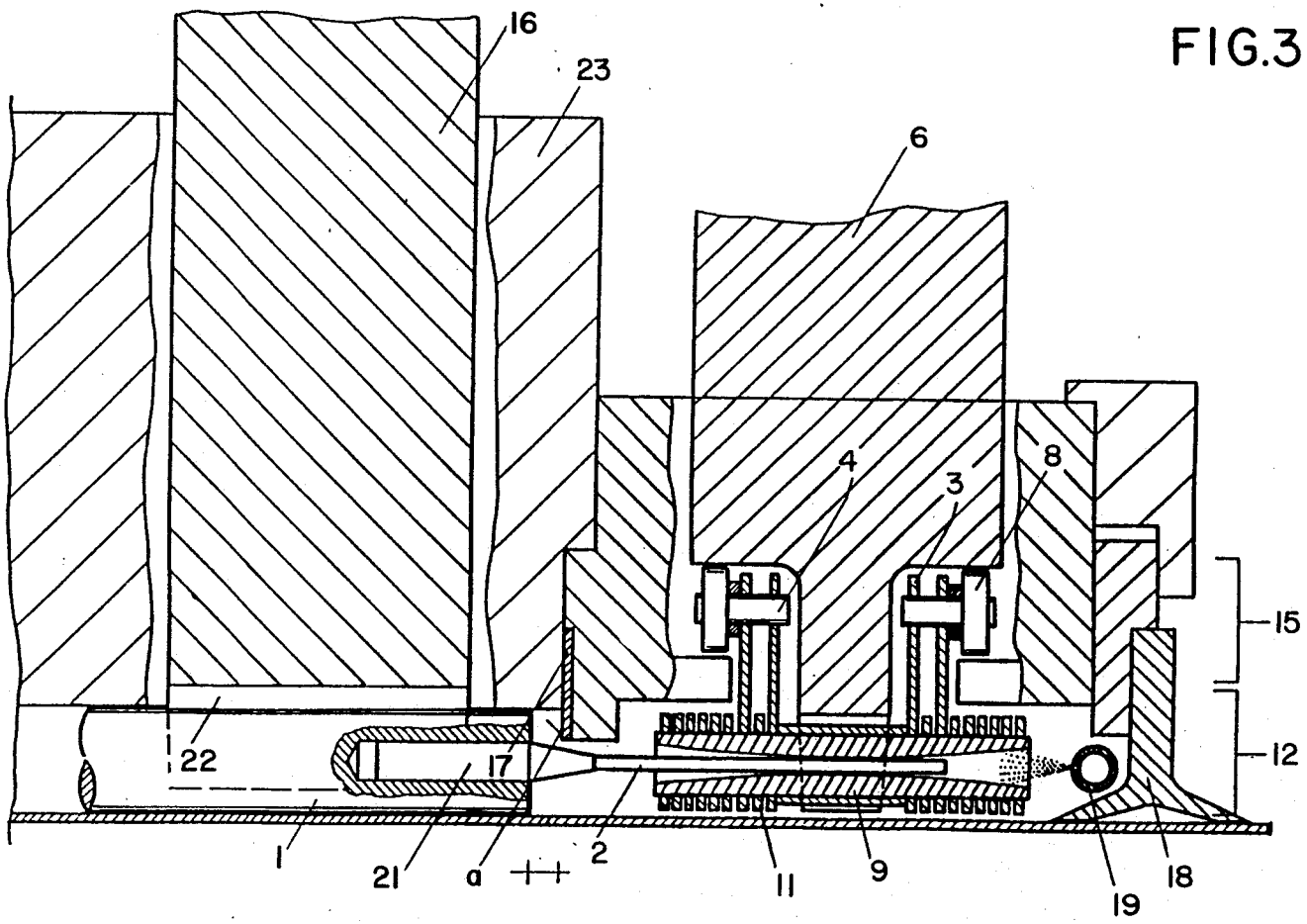
FIG. 3 is a second embodiment of the guide chain in a view similar to FIG. 2.

For presses of smaller dimensions and with a lower pressing force, it may be sufficient to provide guide chains 12 with only one protective roller 5 and with correspondingly designed entering gear wheels 6 as shown in FIG. 3.

Figure 2:
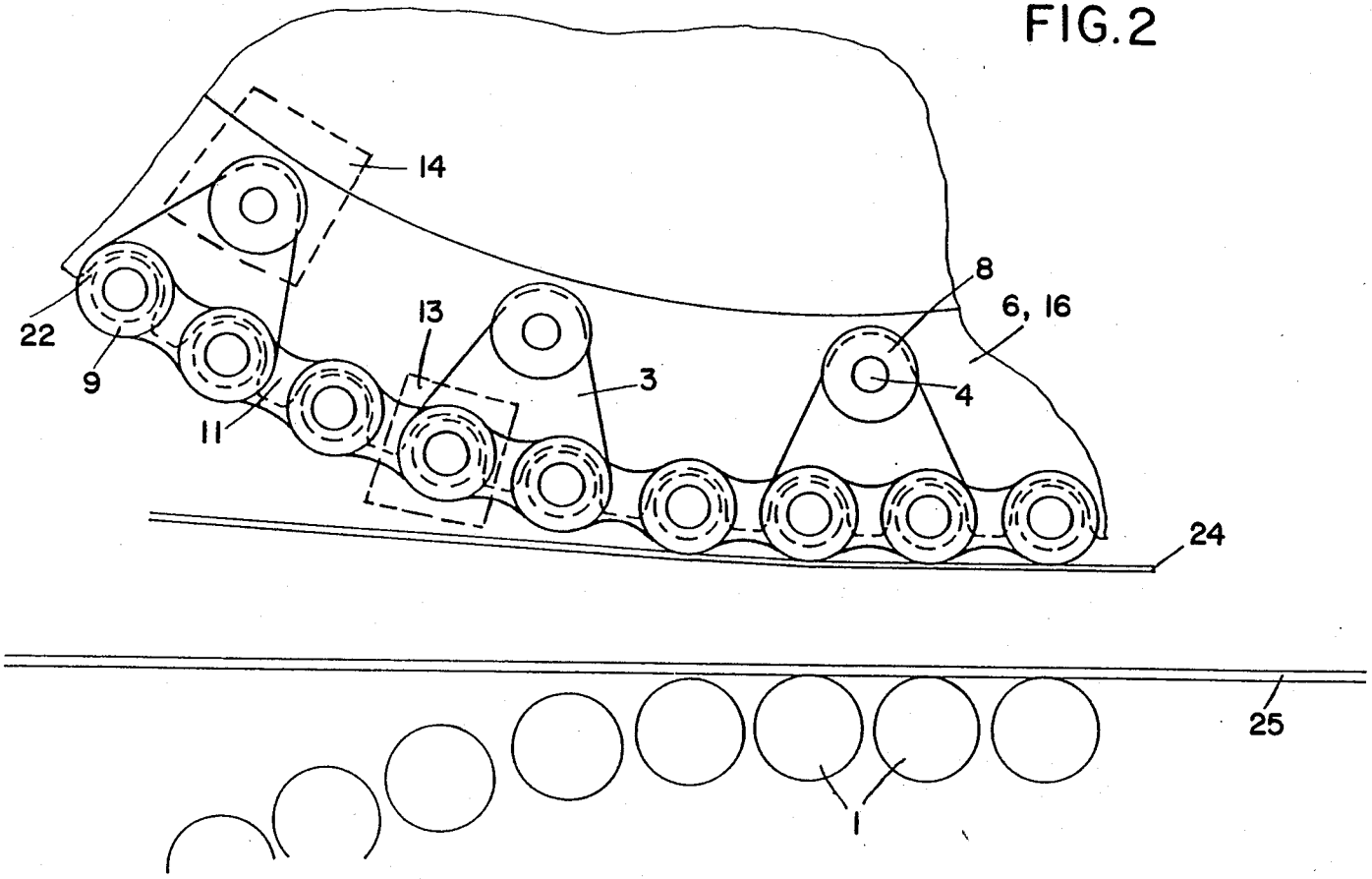
FIG. 2 is a sectional side view of the guide chain with rolling rods in the entering arc.

The design of the guide chain 12 and the tangential transition from the entering arc into the horizontal pressing plane are illustrated in FIG. 2. During idling, that is, when the steel band 24 as driving element sags in the upper strand of the continuous press, the guide chain 12 is supported in a rolling manner in guide rails by means of suspension plates 3 via running rollers 8. A link 14 of this supporting chain 15 is formed by suspension plates 3 and chain studs 4.

It can also be seen from FIGS. 1–3 that the protective rollers 5 are guided by means of recesses 7 of the entering gear wheels 6 and the rolling rods 1 by means of recesses 22 of the lead-in gear wheels 16. The rotation of the rolling rods via the supporting wheels 28 and 31 is shown in FIG. 4.

It should become obvious to those skilled in the art that this invention is not limited to the preferred embodiments shown and described.

What is claimed is:

1. A continuously working press comprising:

a table member;

a press member disposed thereover defining a horizontal pressing plane therebetween;

first and second flexible bands disposed about said table member and press member, respectively;

rotating means which rotates said bands about said table member and press member;

a plurality of roller rod conveyor assemblies disposed between said table and press members and said flexible bands;

each of said roller rod conveyor assemblies comprising:

(a) a plurality of roller rods extending perpendicular to the direction of rotation of said flexible bands, (b) a lead-in wheel which derives said roller rods onto said horizontal pressing plane, (c) a guide chain means connected to said roller rods via resilient connecting means and extending beyond the pressing plane, each of said resilient connecting means having a first portion located within said guide chain means and a second portion disposed within one of said roller rods, (d) an entering wheel coaxial with said lead-in wheel and which drives said guide chain onto said horizontal pressing plane with the same arc and secant dimensions as the path of said roller rods, and (e) a plurality of supporting wheels which support and guide chain means beyond the pressing plane;

said guide chain means defining a tapered bore for receiving said first portion of said resilient connecting means and absorbing forces from the resilient connecting means.

2. The continuously working press according to claim 1 wherein said resilient connecting means are bearing bolts which displaceably connect said guide chain means and said roller rods axially and rotatably.

3. The continuously working press according to claim 2 wherein said bearing bolts have a head portion mounted in bores in said roller rods.

4. The continuously working press according to claim 3 wherein said bearing bolts include a frusto-conical portion coterminous with said head portion.

5. The continuously working press according to claim 4 including a stop means extending into the pressing plane arranged to limit said axial displacement of said rolling rods.

6. The continuously working press according to claim 2 wherein said guide chain means comprises a plurality of links forming an endless chain, adjacent links being connected by a plurality of plates so that forces absorbed by said bearing bolts are transmitted to said plates.

7. The continuously working press according to claim 6 wherein said plurality equals 6.

8. The continuously working press according to claim 6 wherein said plurality equals 7.

9. The continuously working press according to claim 2 wherein said bearing bolts are formed of a force transmitting material.

10. The continuously working press according to claim 9 wherein said force transmitting material is spring steel.

11. The continuously working press according to claim 6, wherein said guide chain means include protective rollers for each chain link, said protective rollers being coaxial with said tapered bore and engaging said entering wheel.

12. The continuously working press according to claim 1, wherein said tapered bore includes an annular bulge which reduces the diameter of said bore, so that forces applied to said resilient connecting means are absorbed by said guide means at said annular bulge.

13. The continuously working press according to claim 12, wherein said tapered bore is coaxial with said roller rods and said resilient connecting means, and said bore increases in diameter from said annular bulge toward said first portion of said resilient connecting means.

14. The continuously working press according to claim 13, further comprising means for supplying lubricant to said tapered bore.

* * * * *